US005274350A

United States Patent [19]

Larson

[11] Patent Number: 5,274,350

[45] Date of Patent: Dec. 28, 1993

[54] SHUNT APPARATUS FOR CURRENT SENSING AND POWER HYBRID CIRCUITS

[75] Inventor: Eric K. Larson, Narragansett, R.I.

[73] Assignee: Texas Instruments Incorporated, Dallas, Tex.

[21] Appl. No.: 985,408

[22] Filed: Dec. 4, 1992

[51] Int. Cl.[5] ..... H01C 7/00

[52] U.S. Cl. ..... 338/49; 338/306

[58] Field of Search ..... 338/49, 306, 307, 308, 338/309, 314

[56] References Cited

U.S. PATENT DOCUMENTS 5,057,811 10/1991 Strott et al. ..... 338/22 R 5,128,616 7/1992 Palmer ..... 324/435

5,189,593 2/1993 Ooi ..... 455/195.1

*Primary Examiner*—Marvin M. Lateef

*Attorney, Agent, or Firm*—Russell E. Baumann; Richarld L. Donaldson; René E. Grossman

[57] ABSTRACT

A shunt resistor for use with current sensing and power hybrid circuits such as a solid state power controller which is adapted to conduct the full load current and serve as a current sensor comprises a base layer of aluminum electrically isolated from and thermally coupled to a circuit layer of monel 401 through a ceramic filled polymer layer. The shunt is provided with spaced wire bond portions for attachment to circuit traces of the controller.

11 Claims, 2 Drawing Sheets

SHUNT APPARATUS FOR CURRENT SENSING AND POWER HYBRID CIRCUITS

FIELD OF THE INVENTION

This invention relates generally to current sensing and more particularly to shunt resistor apparatus for use with solid state power controllers.

BACKGROUND OF THE INVENTION

Conventionally, in power distribution systems of the type employed in aircraft, each load circuit incorporates both a relay for switching current and a thermal circuit breaker to protect the circuit wiring from overloads. The relay and circuit breaker for many circuits are located in the cockpit for flight crew operation requiring heavy gage wire to run from the generator to the cockpit and then to the load resulting in a substantial weight penalty.

In U.S. Pat. No. 4,866,559 a solid state protective circuit is disclosed which is capable of remotely switching power to a load in which an electrothermal sensor is positioned in heat transfer relationship with a resistive element in series with the power line to the load to monitor the current to the load and provide a signal to control logic indicative of the sensed current determined from the amount of heating caused by the current flow through or in the line coupled to the electrothermal sensor, the amount of heat being determined by the electrothermal sensor.

Another solid state power controller is shown and described in copending application Ser. No. 985,406, filed on Dec. 4, 1992 assigned to the assignee of the present invention. The controller in the referenced application uses a shunt resistor as a current sensing mechanism. The shunt resistor is adapted to conduct the full current load from the power generator to the load and the controller measures the voltage drop across the resistor apparatus and processes this measurement to limit current to the load to a safe level. The controller limits current in accordance with a selected curve of time versus percent overload current. An example of a controller of this type comprises a hybrid assembly having a substrate on which are mounted selected ASICS, FETS, resistors, capacitors and a back-up fuse as well as the shunt resistor in a package in the order of two inches in length, one and a third inches in width and a third of an inch in height.

One of the problems in providing a shunt resistor for use with the controller is the small amount of space available for the resistor and the need to conform with standard hybrid assembly techniques. The shunt resistor must be able to dissipate the power that the controller is designed to handle and still be able to be of a size and type to be mounted within the controller package. Conventional discrete resistors which have the ability to handle the required power are too large to fit within the package. Conventional thick film resistors are not suitable because of their limitations in power dissipation. Other devices which are unsuitable include plastic encapsulated wire welded to contacts. While these devices can handle the normal steady state power loads they are not able to handle the required overload and as a result overheat on such overloads and crack or even break out of their encapsulants due to wire expansion.

SUMMARY OF THE INVENTION

It is therefore an object of the present invention to provide shunt resistor apparatus which can dissipate the power that it generates within the solid state power controllers and yet be sufficiently small in size to fit within the controller package.

Another object of the invention is the provision of a shunt resistor which is amenable to surface mount technology and which has high current carrying capability along with a stable resistance over a wide temperature range for which the controller is designed to operate, e.g., from −565° C. to 80° C.

Yet another object is the provision of a shunt which is reliable and cost effective.

Other objects and advantages of the present invention will become more fully apparent from the following detailed description when read in conjunction with the accompanying drawings.

Briefly, in accordance with the invention, a shunt resistor for use with a solid state power controller which is adapted to switch current to a load through a wire in which the shunt resistor conducts the full load current and which serves as current sensor comprises a base layer of copper or aluminum, preferably aluminum, on which is adhered a single layer of ceramic filled polymer with a circuit layer of Monel 401 adhered to the polymer layer. The circuit layer allows low resistance values to be obtained (e.g., 1 to 100 mohms) with required accuracy of +/−10% and temperature stability within +/−50 ppm/° C. −55° up to 150° C. The circuit layer has first and second wire bond portions on opposite ends thereof for power line attachment and first and second pad locations intermediate the ends so that wire bonds will be properly separated to yield the required resistance and therefore to sense precise voltage drop.

DESCRIPTION OF PREFERRED EMBODIMENTS

Figure 1:
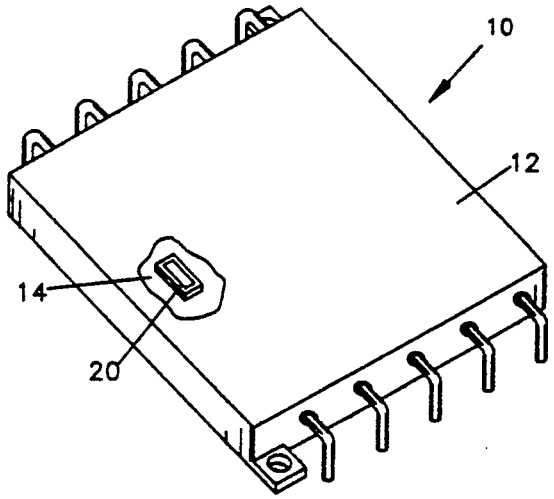
FIG. 1 is a perspective view of a solid state power controller package, partly broken away to show a shunt resistor made in accordance with the invention.

As seen in FIG. 1 a solid state power controller 10 is shown comprising a package 12 containing a substrate 14 on which is disposed circuit traces as well as various hybrid components (not shown) including resistors, capacitors, FETS and ASICS. A shunt resistor 20 is disposed in package 12 and is surface mounted to substrate 14 by conventional hybrid surface assembly techniques, such as by being fixed thereto with suitable epoxy.

Figure 2:
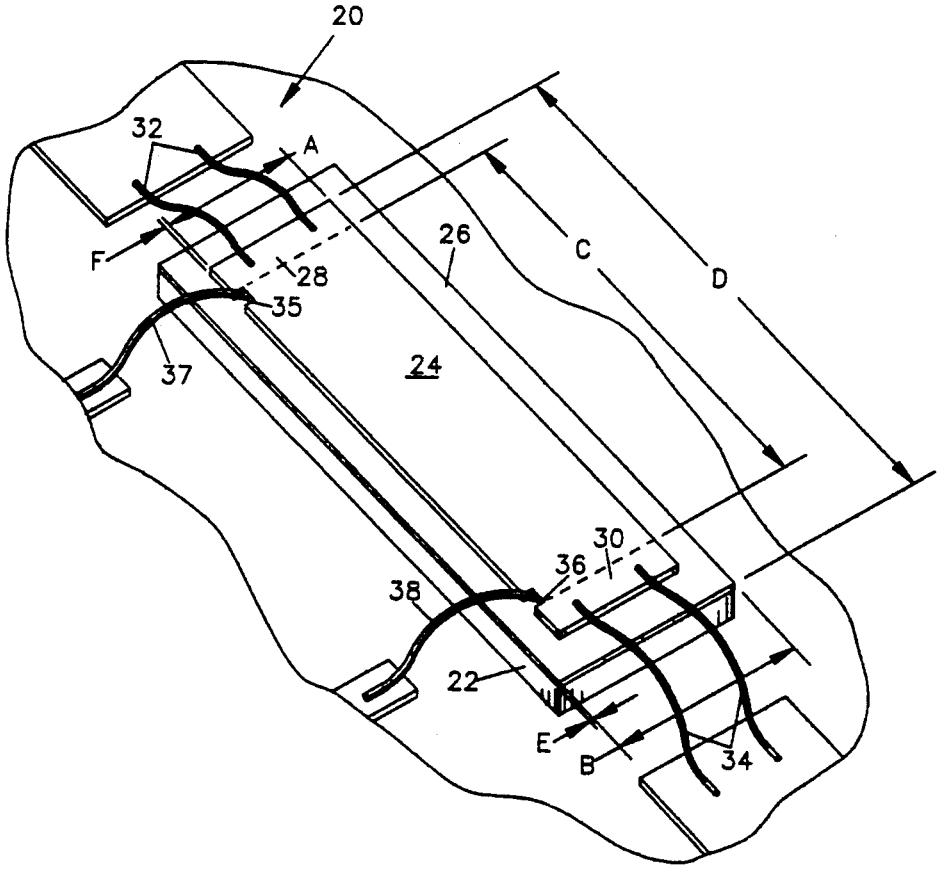
FIG. 2 is an enlarged perspective view of the shunt resistor shown in FIG. 1.

With reference to FIG. 2, shunt resistor 20 comprises a base layer 22 selected to facilitate heat removal, provide mechanical strength and to be compatible with conventional hybrid substrate mounting techniques. A circuit layer 24 is disposed on base layer 22 with a dielectric layer 26 therebetween. Layer 24 is formed of a metal foil of material selected having the desired resistivity and a low thermal coefficient of resistance (tar)-plus or minus 50 ppm/° C. resistance change over the operating temperature range and up to 150° C., and to be compatible with wire bonding techniques. Dielectric layer 26 is formed of a material which not only provides the required electrical isolation between circuit layer 24 and base layer 22 but also is thermally conductive in order to dissipate the energy generated in the circuit layer and therefore must be capable of forming a good physical bond between layers 22, 24.

Circuit layer 24 is preferably formed of Monel 401 (55% Cu-45% Ni alloy) since it meets all of the above noted requirements. Monel 401 is wire bondable and is cost effectively formed into its desired resistance pattern by conventional etching techniques. The material can also be effectively bonded to the base layer using thermally conductive material to be explained below. Monel 401 also has a low temperature coefficient of resistivity within the required operating temperature range.

Base layer 22 is preferably formed of aluminum which meets the requirements of thermal conductivity, mechanical strength, conformance with conventional hybrid mounting techniques and being readily bondable to the selected dielectric layer 26.

Dielectric layer 26 is preferably formed of a ceramic filled polymer having a thermal conductance of approximately 3 watts/meter K or greater in order to provide effective thermal transfer while minimizing size. The shunt is constructed by taking an aluminum base layer 22 of convenient thickness, e.g., 014.067–0.057 inch, and a monel foil for circuit layer 24 of a selected thickness and placing dielectric layer 26 of a selected thickness therebetween and pressing the assembly together under suitable temperature and pressure conditions to adhere layer 26 to both layers 22 and 24. Ceramic filled polymer material of this type is disclosed in U.S. Pat. Nos. 4,810,563 and 4,574,879 and is available from The Bergquist Company. Although the materials described in the patents comprise separate layers for thermal conductance and adhesion a single layer that serves both as a thermal conductor and an adhesive is also available from that company. The shunt material is manufactured in panel form which is then processed into individual components via standard etching and blanking techniques. Photoresist is laminated on the circuit layer and exposed to an ultraviolet light through a photonegative having the desired pattern to yield the shunt resistance value and having adequate size for power dissipation requirements. After developing the surface is etched in a conventional manner. Circuit layer 24 is formed with wire bond areas 28, 30 at opposite ends thereof to permit bonding of wires 32, 34, for power in and power out respectively. Notches 35 and 36 serve as locators for wire bond sense pads for attachment of wires 37, 38 respectively to provide a resistance C which is used to monitoring voltage drop as current flow changes. Specific dimensions, in inches, of shunts made in several ampere ratings for both 270 VDC and 28 VDC are shown in the table below in conjunction with FIG. 2.

| AMP Rating | Voltage | A | B | C | D |
|---|---|---|---|---|---|
| 10.0 | 270 VDC | .120–.124 | .164–.174 | .198–.202 | .335–.345 |
| 7.5 | 270 VDC | .096–.100 | .164–.174 | .198–.202 | .335–.345 |
| 5.0 | 270 VDC | .060–.064 | .164–.174 | .198–.202 | .335–.345 |

-continued

| AMP Rating | Voltage | A | B | C | D |
|---|---|---|---|---|---|
| 2.5 | 270 VDC | .029–.033 | .164–.174 | .198–.202 | .335–.345 |
| 10.0 | 28 VDC | .218–.222 | .264–.274 | .408–.412 | .540–.550 |
| 7.5 | 28 VDC | .169–.173 | .264–.274 | .408–.412 | .540–.550 |
| 5.0 | 28 VDC | .112–.116 | .264–.274 | .408–.412 | .540–.550 |
| 2.5 | 28 VDC | .055–.059 | .264–.274 | .408–.412 | .540–.550 |

The thickness of the dielectric layer 26 (E) was 0.0029–0.0025 and the thickness of circuit layer 24 (F) was 0.0037–0.0033 in each of the above examples. The E and F dimensions were selected based on the need to provide power dissipation as well as the practicality and cost effectiveness related to etching times. It will be understood that using different E and F dimensions would necessitate appropriate changes in the other dimensions to obtain the selected resistance level.

Figure 3:
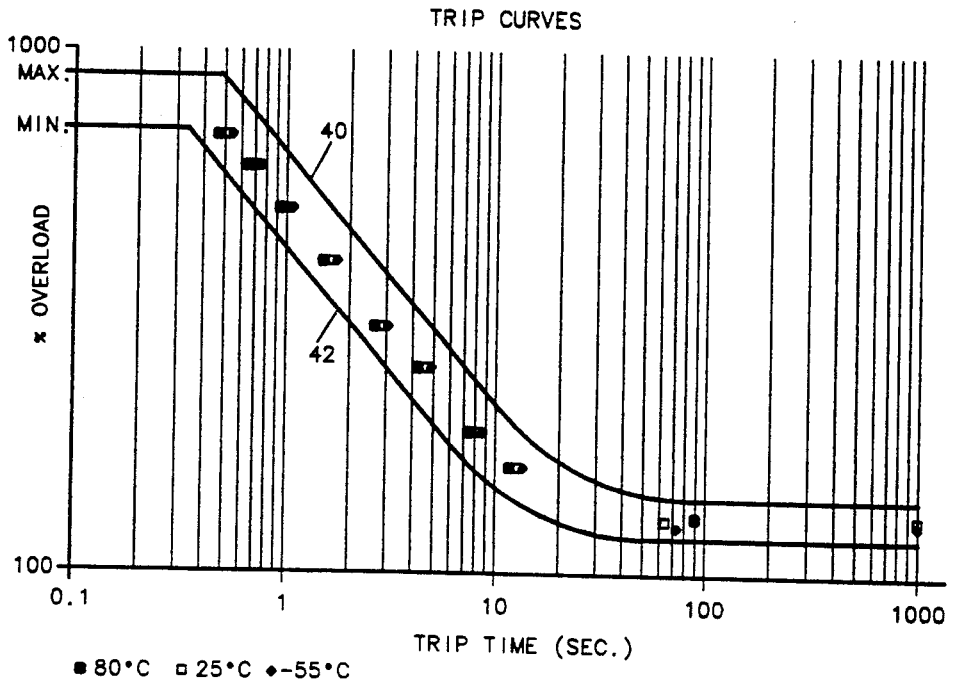
FIG. 3 is a graph of trip time versus percent overload current of a controller with which the shunt resistor is used.

As noted in FIG. 3 which shows maximum and minimum trip curves 40, 42 of the controller at operating temperatures of −55° C., 25° C. and 80° C. using a shunt made in accordance with the invention and having dimensions shown in the above table indicate the close grouping of the different test points due to the low TAR. Further, although a generally rectangular pattern has been employed with each of the ratings since it provides a desirable large surface area thereby enhancing thermal dissipation of the power it will be understood that other patterns could be used if desired.

Figure 4:
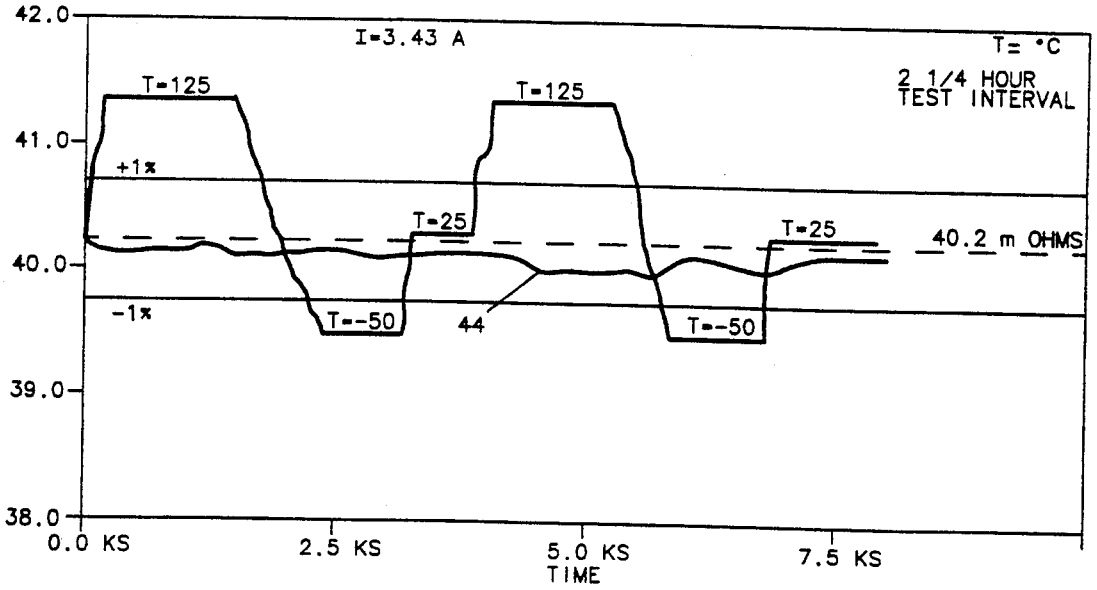
FIG. 4 is a graph of resistance versus temperature of a shunt resistor made in accordance with the invention conducting various load currents.

FIG. 4 shows resistance variations over temperature for a shunt used without the referenced controller, conducting various full load currents. It will be noted that curve 44 is within a narrow band required for precision current sensing applications.

While there has been illustrated and described what at present is considered to be the preferred embodiments of the invention it will be understood by those skilled in the art that various changes and modifications may be made and equivalents may be substituted for elements thereof without departing from the true scope of the invention. It is intended that the invention will include all embodiments falling within the scope of the appended claims.

We claim:

1. A shunt resistor for use with a solid state power controller adapted to switch current to a load through a wire, the shunt resistor adapted to conduct full load current and serve as a current sensor comprising a rigid base layer formed of thermally conductive material, the base having a top and bottom surface, the bottom surface adapted to be mounted to a flat hybrid substrate, a ceramic filled polymer dielectric layer adhered to the top surface of the base layer;

a circuit layer adhered to the dielectric layer, the circuit layer formed of metal foil having a low resistance in the mohm range and a stable resistance over a temperature range of −55° C. to 150° C. and having first and second wire bond portions at opposite ends of the circuit layer and first and second sense pads intermediate the opposite ends.

2. A shunt resistor according to claim 1 in which the circuit layer is an alloy of 55% Cu and 45% Ni.

3. A shunt resistor according to claim 1 in which the base layer is aluminum.

4. A shunt resistor according to claim 2 in which the base layer is aluminum.

5. A shunt resistor according to claim 1 in which the base layer is copper.

6. A shunt resistor according to claim 2 in which the base layer is copper.

7. A shunt resistor according to claim 1 in which the ceramic filled polymer is a single layer which is both thermally conductive and adhered to the base and circuit layers.

8. A shunt resistor for use with a solid state power controller adapted to switch current to a load through a wire, the shunt resistor adapted to conduct full load current and serve as a current sensor comprising a base layer of aluminum having a top and bottom surface, the bottom surface adapted to be mounted to a flat hybrid substrate, a ceramic filled polymer dielectric layer laving a nominal thickness of 0.0027 inches adhered to the top surface of the base layer, a circuit layer of an alloy of 55% Cu and 45% Ni having a nominal thickness of 0.0035 inches and having first and second wire bond portions at opposite ends of the circuit layer.

9. A shunt resistor according to claim 8 in which the ceramic filled polymer is a single layer which is both thermally conductive and adhered to the base and circuit layers.

10. A shunt resistor according to claim 1 in which he resistance between the first and second sense pads is within approximately 1-100 mohms (+/−10%).

11. A shunt resistor according to claim 1 in which the circuit layer has a temperature efficient of resistive of approximately +/−50 ppm/° C.

* * * * *